United States Patent [19]

Finsterwalder et al.

[11] Patent Number: 4,850,746

[45] Date of Patent: Jul. 25, 1989

[54] ROCK ANCHOR ASSEMBLY FOR SECURING ROADWAYS AND WALL SURFACES OF OPEN CUTS AND TUNNELS

[75] Inventors: Klemens Finsterwalder; Rüdiger Bartsch, both of Kirchweg, Fed. Rep. of Germany

[73] Assignee: Dyckerhoff & Widmann Aktiengesellschaft

[21] Appl. No.: 182,978

[22] Filed: Apr. 18, 1988

[30] Foreign Application Priority Data

Apr. 18, 1987 [DE] Fed. Rep. of Germany ..... 3713291

[51] Int. Cl.[4] ..... E21D 20/02

[52] U.S. Cl. ..... 405/260; 405/288; 411/9

[58] Field of Search ..... 405/259, 260, 261, 262, 405/288; 411/1, 2, 8, 9, 82

[56] References Cited

U.S. PATENT DOCUMENTS

| | | | |
|---|---|---|---|
| 4,124,983 | 11/1978 | Weatherby | 405/260 |
| 4,386,876 | 6/1983 | Dupeuble | 405/260 |
| 4,630,971 | 12/1986 | Herbst et al. | 405/260 |
| 4,664,555 | 5/1987 | Herbst | 405/260 |
| 4,664,561 | 5/1987 | Frease | 405/261 |

FOREIGN PATENT DOCUMENTS

| | | |
|---|---|---|
| 3417252 | 4/1986 | Fed. Rep. of Germany . |
| 3531393 | 6/1986 | Fed. Rep. of Germany . |

*Primary Examiner*—David H. Corbin
*Attorney, Agent, or Firm*—Toren, McGeady & Associates

[57] ABSTRACT

To secure roadways and wall surfaces of open cuts and tunnels, a rock anchor assembly is inserted into and secured within a borehole in a receiving material. The rock anchor assembly is made up of an axially elongated tension member laterally enclosed in part by an axially elongated sheathing tube so that the tension member projects outwardly from the opposite ends of the sheathing tube. In the insertion direction, the leading end of the sheathing tube is secured in tension-resistant locked engagement with the tension member. Initially, a hardenable adhesive material is injected into a borehole and then the assembled tension member and sheathing tube are inserted into the adhesive material so that the unsheathed end of the tension member is anchored in the base of the borehole. The trailing end of the sheathing tube has a flange which bears against a anchor plate in contact with the surface of the receiving material in which the borehole is formed. An anchor nut is secured on the tension member and presses the trailing end of the sheathing tube against the anchor plate and the anchor plate against the receiving material. Accordingly, the leading end of the tension member and the anchor plate can be used in common by both the tension member and the sheathing tube for anchoring purposes with the sheathing tube anchored at both of its ends.

13 Claims, 2 Drawing Sheets

ROCK ANCHOR ASSEMBLY FOR SECURING ROADWAYS AND WALL SURFACES OF OPEN CUTS AND TUNNELS

BACKGROUND OF THE INVENTION

The present invention is directed to a rock anchor assembly for securing roadways and the wall surfaces of open cuts and tunnels. The anchor bolt assembly is formed of an axially elongated tension member laterally enclosed at least along a portion of its length within a sheathing tube. The leading end of the tension member is anchored within the base of the borehole and the trailing end of the sheathing tube is pressed against an anchor plate abutting against the surface of the receiving material in which the borehole is formed. The sheathing tube extends along a considerable part of the tension member within the borehole and, at its leading end, the sheathing tube is in positive locked engagement with the tension member at a location adjacent but spaced from the leading end of the tension member.

In a known rock anchor assembly of this type, a steel sheathing tube is bonded with the tension member over the length of the anchoring distance at the end of the tension member located within the borehole so that the tension member extends from the end of the sheathing tube with only a short mixing tip, note DE-PS 34 17 252. To assure that the sheathing tube fractures at a specific location in the event of an overload, a rated failure location is provided in the sheathing tube at the end of the anchored distance. The remainder of the sheathing tube extending to the location where the tension member is anchored on the outside of the borehole is in bonded connection with a hardenable synthetic resin adhesive material which fills the borehole.

In this known rock anchor assembly, the sheathing tube, which has a surface configuration for enhancing the bond with the adhesive material, acts as a rigid anchor. As soon as forces are developed due to displacement of a rock formation exceeding the load capacity of the sheathing tube, the tube is intended to fracture at the rated failure location, so that the extensibility of the tension member located within the sheathing tube becomes active. Accordingly, it is possible to take advantage with one anchoring assembly of a rigid and then an extensible anchor member.

In another development of the known rock anchor assembly, the sheathing tube is made up of at least three sections connected together by rated fracture locations in a frictionally locking manner, with only the sections arranged at the opening into the borehole and at the base of the borehole provided with a profiled configuration for enhancing bonding with the adhesive. Between the profiled surfaces, the sheathing tube has a smooth surface section, note DE-PS 35 31 393. This arrangement is intended to prevent the sheathing tube, embedded over its entire length into the hardenable synthetic resin adhesive filling the borehole, from possibly fracturing at the location of an opening in the rock formation if its load carrying capacity is exceeded and the forces are suddenly applied on the load yield characteristic of the tension member alone. Due to the smooth surface of the central section located between the end sections of the sheathing tube, which are in bonded connection with the adhesive material, and the arrangement of the rated fracture locations of the sections of the sheathing tube fastened to the tension member, it is intended that the sheathing tube fail at the rated fracture points if an opening develops in the rock formation so that an additional change in length occurs under the influence of friction with respect to the hardenable adhesive material surrounding the sheathing tube, which friction affords the compensation of the load yield curve.

The most dangerous stresses for such a rock anchor assembly are displacements in rock formations with respect to one another in a direction extending transversely of the axial direction of the tension member, which tend to shear the tension member. As a result, the maximum force acting on the tension member is located at the point of the shearing action and not at the anchorage. As the bond between the tension member and the hardenable synthetic resin adhesive material filling the borehole improves, then the shorter would be the effective length of the external forces acting on the tension member and the higher stresses arising in it. The disadvantage of this known rock anchor assembly is that, even if the surface of the sheathing tube is shaped along specific sections for increasing its bond, comparatively large lengths of the sheathing tube are required for anchoring it in the boreholes which are not available for its function especially with reference to displacement in the rock formation. This known anchor assembly is not effective if a rock formation displacement takes place in the region of one of the anchoring sections in the base of the borehole or near the opening into the borehole. Moreover, additional expense is involved in shaping the sheathing tube surface for improving its bonding action.

SUMMARY OF THE INVENTION

Therefore, it is the primary object of the present invention to provide a rock anchor assembly of the known type to avoid long anchoring sections of the sheathing tube on the tension member and also to avoid rated fracturing or breaking locations in the sheathing tube.

In accordance with the present invention, the axially extending part of the tension member extending out of the sheathing tube in the base of the borehole serves to anchor the tension member and the sheathing tube connected to it in a tension-resistant manner with the tension member being anchored in the hardenable adhesive material filling at least the base of the borehole. Further, the sheathing tube is anchored in a tension-resistant manner along with the tension member at the entrance to the borehole where an anchor plate bears against the surface of the receiving material into which the borehole is formed.

The essential advantage of the present invention is that the sheathing tube is anchored at its end within the borehole by the hardenable synthetic resin adhesive material securing the tension member extending from the end of the sheathing tube. Further, it is anchored at the opening to the borehole against the anchor plate which bears directly on the surface of the receiving material. Since both anchorages are achieved between metallic materials and thus in the shortest possible way, the sheathing tube is available for approximately its entire length for carrying forces developed from displacements in the rock formation. As a result, with the anchor assembly, two anchor members are obtained in one, since the anchoring distance of the tension member as well as the anchor plate are used by the sheathing tube as well as by the tension member itself. At the same time, special features, which would possibly be required to afford better bonding properties to the sections of the sheathing tube with the adhesive material filling the borehole, are not required.

Initially, after installation of the anchor assembly, the sheathing tube embedded in the synthetic resin adhesive material acts as a rigid anchor and later, if the sheathing tube has failed, the tension member becomes active with its greater extensibility within the sheathing tube. Accordingly, it is possible with the anchor assembly formed in accordance with the present invention to experience displacement movement of 300 to 400 mm or more, with a large initial force, up to to the time of failure of the tension member.

In combination with the tension member, the sheathing tube extends at its trailing end through the anchor plate and can be provided with its own tension-resistant anchoring means upon which the anchoring member of the tension member abuts. The anchoring means may be in the form of a flange on the end of the sheathing tube and in contact with the anchor plate. Friction between the sheathing tube and the tension member can be reduced by lubrication to increase its deformability. With such an arrangement the force distribution is more favorable with a S-shaped bend line of the anchor assembly and the overall deformability of the tension member is increased in the region of rock formation displacement.

It is also advantageous in the present invention that no special measures are required for the installation of the anchor assembly, that is, the tension member or anchor member can be inserted in the same manner as is used with known rock anchor assemblies.

If, as is considered especially appropriate, a reinforcing bar is used as the tension member, and is equipped with hot rolled load-carrying ribs on its surface with the ribs extending along a helical line and forming at least a partial thread, the tension-resistant connection of the sheathing tube with the tension member can be effected by pressing the tube around the anchor rod near the base of the borehole.

The anchor plate is placed at the trailing end of the assembly, before the assembly made up of the tension member and the sheathing tube is inserted, to provide an abutment for the sheathing tube, that is, if the sheathing tube is provided with an outwardly directed flange so that it bears against the anchor plate. By placing an anchor member on the tension member, such as threading an anchor nut onto the at least partial thread on the reinforcing rod-tension member, the trailing end of the sheathing tube along with the tension member is anchored against the anchor plate, both at the same location.

Due to the arrangement of the rock anchor assembly of the present invention, the extensibility of the assembly during rock formation displacement is considerably increased, particularly by introducing a lubricant into the space between the tension member and the sheathing tube. An additional increase in extensibility can be achieved by using an anchoring member on the trailing end of the assembly so that relative movement between the tension member and the anchoring member can be achieved if a preset longitudinal tensile force on the tension member is exceeded until the tensile force drops below the pre-set value. Such an anchoring member is disclosed in DE-PS 35 03 012 and corresponding U.S. Pat. No. 4,630,971.

No special conditions have to be observed when installing the rock anchor assembly of the present invention. If protective nettings for securing an excavation wall are to be installed at the same time as the anchor assembly, a junction of the protective netting in the region of the anchor assembly is possible in a simple manner with the end of one protective netting section fixed by an inner anchor plate, with the end of the sheathing tube abutting the inner anchor plate and with the end of the adjacent protective netting section placed over the projecting tension member and secured by an outer anchor plate with the anchoring member, such as an anchor nut, abutting against the outer anchor plate.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
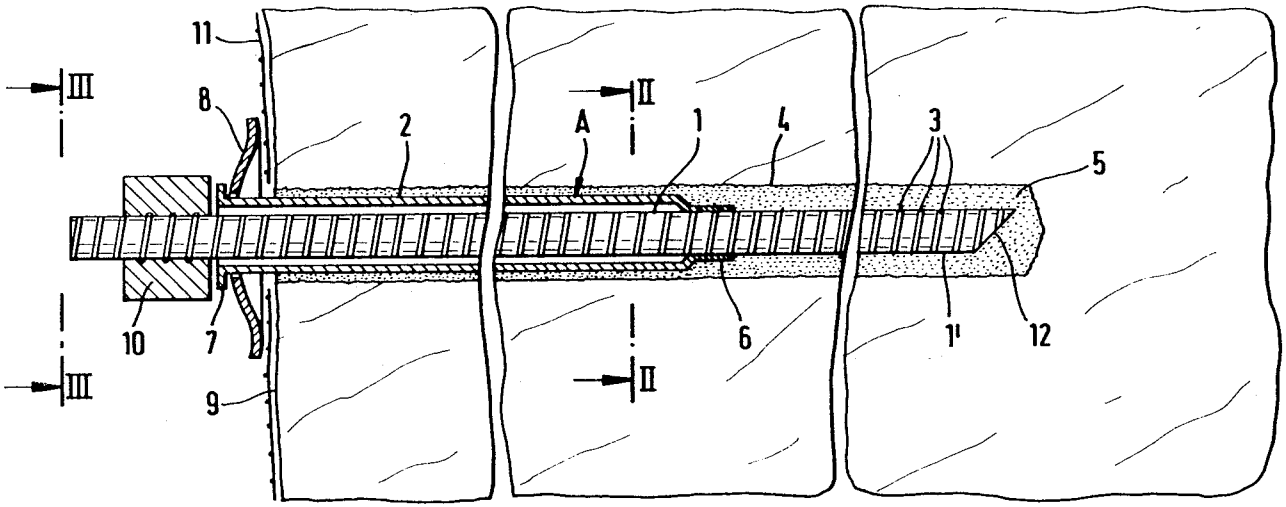
FIG. 1 is an axially extending section through a rock anchor assembly embodying the present invention.
Figure 2:
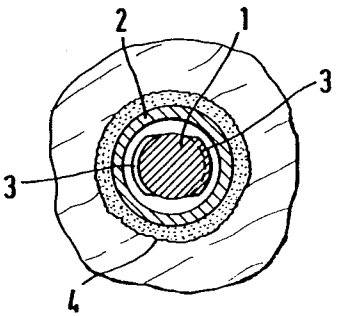
FIG. 2 is a transverse sectional view taken along the line II—II in FIG. 1.
Figure 3:
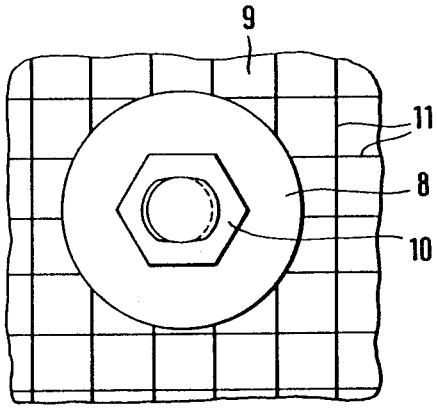
FIG. 3 is an elevational view of the trailing end of the rock anchor assembly taken along the line III—III in FIG. 1.

FIG. 1 discloses an interrupted axially extending section through a rock anchor assembly embodying the invention with the assembly made up of an axially elongated anchor rod or tension member 1, laterally enclosed by an axially elongated sheathing tube 2, formed of steel and extending over most of the length of the tension member. The rod or tension member 1 is a hot rolled steel bar as shown, provided with oppositely located load-carrying ribs 3, extending along a portion of the circumferential periphery of the tension member with the ribs extending along a helical path and forming a partial thread. Note in FIG. 2, the oppositely located ribs 3 spaced angularly apart. The tension member 1 has a leading end 1' located in the base of a borehole 5, formed in a receiving material, such as a rock formation. Within the borehole, the axially extending leading end section 1' of the tension member 1, projects out of the corresponding leading end of the sheathing tube 2. The leading end section 1' of the tension member 1, forms a so-called anchoring section with the tension member 1 fixed by a hardenable synthetic adhesive material 5, filling the base of the borehole and extending around the sheathing tube 1 to the opening into the borehole 4 at the surface of the receiving material.

At its leading end 6, sheathing tube 2, is secured in a tension-resistant manner to the tension member 1 so that the axially extending leading end section 1' of the tension member projects from the sheathing tube into the base of the borehole. The connection between the tube 2 and the tension member 1 can be effected in a simple manner by pressing the leading end of the tube radially inwardly so that the end of the tube 2 begins to flow and engages the load-carrying ribs 3 of the tension member 1 in a frictional and positively locked manner. From its leading end, toward its trailing end, the sheathing tube 2 laterally encloses the tension member 1 with slight play so that the tension member 1 can extend independently of the sheathing tube. A known lubricant can be injected into the annular space between the tension member 1 and the sheathing tube 2.

At its trailing end, spaced closely outwardly from the opening into the borehole 2, the sheathing tube 2 has an outwardly directed flange 7 extending transversely of the axial direction of the tube. The surface of the flange 7 facing the receiving material bears against a dish-shaped anchor plate 8, arranged to bear against the surface of the receiving material in which the borehole 4 is formed. The anchor assembly A secures the anchor plate 8 against the wall surface of the receiving material. The anchoring of the sheathing tube 2 provided by the flange 7, is shown only as one example and could be achieved by other means such as a nut threaded onto the exterior surface of the trailing end of the sheathing tube 2.

In FIG. 1, an anchor nut 10 is used as the anchor member at the trailing end of the tension member 1, the nut is threaded onto the partial thread of the tension member formed by the load-carrying ribs 3. A protective netting 11 can be fastened to the surface 9 of the receiving material into which the borehole 4 is formed.

For its installation, the anchor assembly made up of the axially elongated tension member or rod 1 and the sheathing tube 2 connected with the tension member at its leading end 6, has been assembled away from the installation site and is delivered to the installation site in its assembled form. The rock anchor assembly A, together with the anchor plate 8, placed around the trailing end of the sheathing tube 2 and the anchor nut 10, threaded onto the trailing end of the tension member 1, is inserted into the borehole and is secured in a known manner by means of a synthetic resin adhesive material 5. Generally, a two-component adhesive material is used as the synthetic resin material. The adhesive material components are contained within separate cartridges and are inserted into the borehole ahead of the rock anchor assembly A. With the insertion of the tension member 1 into the borehole, its mixing tip breaks or destroys the cartridges and mixes the components so that the adhesive material is activated. After the adhesive material hardens or sets, the anchor nut is tightened on the trailing end of the tension member 1, bracing the trailing end of the sheathing tube 2 and the anchor plate 8 against the outside surface 9 of the receiving material.

Figure 4:
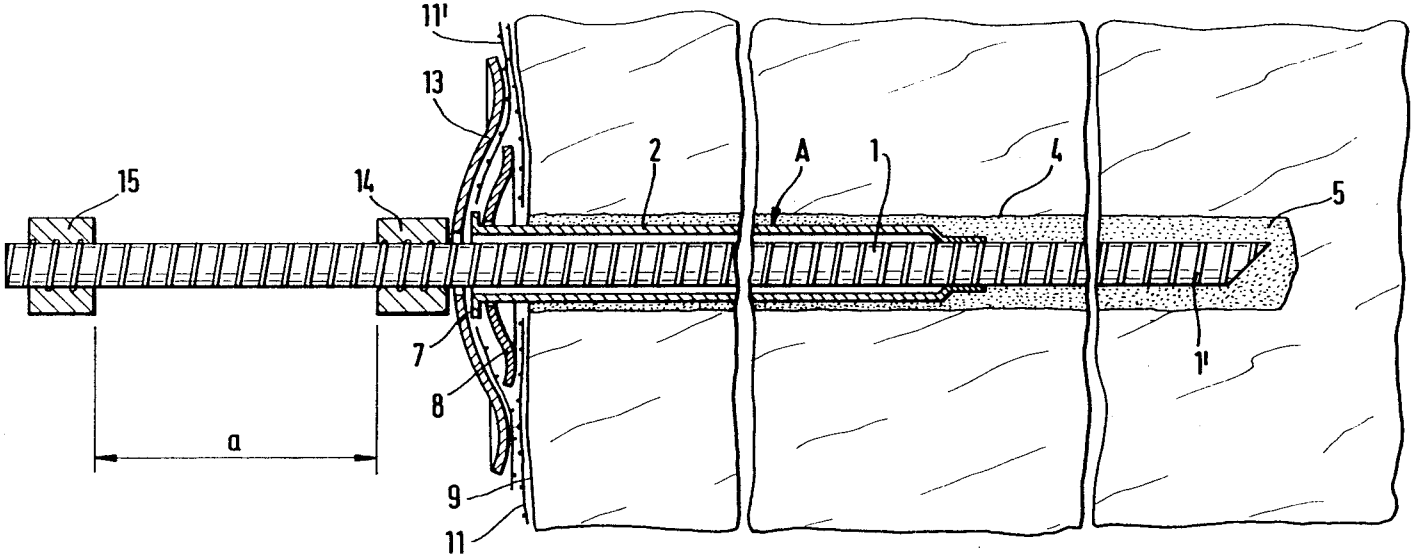
FIG. 4 is an axially extending sectional view similar to FIG. 1 illustrating another embodiment of the rock anchor assembly incorporating the present invention.

Another embodiment of the present invention is illustrated in FIG. 4, similar to FIG. 1, displaying an interrupted axially extending section through a rock anchor assembly. In the same manner as in FIG. 1, an anchoring assembly A is secured in the base 1' of the borehole with the tension member 1 of the assembly anchored in the synthetic resin adhesive material 5, filling the borehole 4. The tension member 1 is laterally enclosed by a sheathing tube 2 along the greater part of its axial length and the leading end 6 of the tube is secured to the tension member at a location spaced from the leading end of the tension member. In addition, an outwardly extending flange 7, disposed transversely of the axial direction of the sheathing tube at its trailing end, bears against an anchor plate 8 at the outside surface 9 of the receiving material in which the borehole 4 is formed. In this embodiment, anchor plate 8 is an inner anchor plate for securing the end of a bottom layer of protective netting 11 against the surface 9 of the receiving material.

To fasten a junction of two protective nettings, the end of one protective netting 11' is stretched over the inner anchor plate 8 with the other netting 11 located between the inner anchor plate and the surface 9 of the receiving material. An outer anchor plate 13, shaped similarly to the inner plate, though larger in size, presses the netting 11' against the surface 9 of the receiving material. An anchor nut 14 is threaded onto the tension member 1 and presses against the outer anchor plate 13 for anchoring the tension member 1.

In this second embodiment, anchor nut 14 is formed as a so-called "slide nut", that is, it is a type of nut suitable for permitting relative motion between the tension member or rod 1 and the anchor nut 14 if a predetermined axially directed tensile force of the tension member is exceeded, until such tensile force drops below the pre-set value. As disclosed in DE-PS 35 03 012, by making the anchor nut 10 from a material of a higher strength than the material of the tension member 1, and by forming the thread flanks of the anchor nut 14 so they only est in part at the load-carrying ribs 3 of the tension member 1, for the purpose of force transmittal, accordingly, if a predetermined axially extending tensile force is exceeded, the ribs 3 on the tension member 1 are stripped to the extent at which they are in engagement with the thread flanks of the anchor nut. Other anchor members can also be used in a analogous manner provided that these conditions are met.

To assure that the extensibility of the tension member or rod 1 is completely utilized, a clamping device 15, for instance, a so-called "stop nut" is fixed adjacent the trailing end of the tension member 1, spaced outwardly by a dimension a from the anchor nut 14, whereby if the anchor nut travels the dimension a, into contact with the clamping device 15, a solid anchoring of the tension member 1 is effected until it breaks or fractures under additional excessive force and is rendered useless.

The ratio of the anchored length 1' of the tension member as compared to the over-all length of the tension member depends on the specific application of the rock anchor assembly. In mines, the ratio has been about 5 to 1, that is, the over-all length of the tension member is five times its anchored length. Further, the length of the deformed connection between the sheathing tube 2 and the tension member 1 is about 0.10 to 0.15 m.

While specific embodiments of the invention have been shown and described in detail to illustrate the application of the inventive principles, it will be understood that the invention may be embodied otherwise without departing from such principles.

We claim:

1. Rock anchor assembly to be secured by an adhesive material in an axially elongated borehole in a receiving material into which the anchor assembly is inserted, such as for use in securing roadways and wall surfaces of open cuts and tunnels, said anchor assembly comprising an axially elongated metallic tension member having a leading end inserted first into the borehole and a trailing end extending out of the borehole, an axially elongated metallic sheathing tube laterally enclosing said tension member and having a leading end and a trailing end with the leading end of said tube located adjacent to and spaced from the leading end of said tension member so that an axially extending leading end section of said tension member projects from said sheathing tube within the borehole, the leading end of said sheathing tube being connected to said tension member, the trailing end of said sheathing tube located adjacent to and spaced from the trailing end of said tension member so that the trailing end of said tension member projects outwardly from the trailing end of said sheathing tube, first anchoring means secured on said tension member adjacent the trailing end thereof, and a first metallic anchor plate to be pressed against the receiving material by the anchoring means, wherein the improvement comprises that the leading end section of said tension member is securable in the borehole by the adhesive material, the leading end of said sheathing tube being in positively locked engagement with said tension member preventing adhesive material from entering said sheathing tube, the trailing end of said sheathing tube located outside of the borehole bears against said first anchor plate with the trailing end of said sheathing tube located on the side of said first anchor plate more remote from the leading end of said sheathing tube, and said sheathing tube forming an annular space around said tension member and extending axially from the leading end of said sheathing tube to the trailing end thereof and said annular space being free of the adhesive material and said sheathing tube being enclosed by the adhesive material for the axial length thereof within the borehole.

2. Rock anchor assembly, as set forth in claim 1, wherein second anchoring means are located at the trailing end of said sheathing tube and said first anchoring means is arranged to press in the axial direction toward the leading end of said sheathing tube against said second anchoring means.

3. Rock anchor assembly, as set forth in claim 2, wherein said second anchoring means comprises a flange formed on the trailing end of said sheathing tube and extending transversely outwardly from said sheathing tube and arranged to abut against said first anchor plate.

4. Rock anchor assembly, as set forth in claim 1, wherein a lubricant is located within said space for increasing the deformability of the tension member.

5. Rock anchor assembly, as set forth in claim 1, wherein said tension member is a rod-shaped member having an outer surface with load-carrying ribs thereon extending outwardly from the outer surface and said ribs forming at least a partial thread, and said first anchoring means comprises a nut with an internal thread matching the partial thread formed by said ribs.

6. Rock anchor assembly, as set forth in claim 1, wherein said first anchoring means includes an anchor member arranged to engage said tension member and to afford relative movement between said anchor member and said tension member if a predetermined axially extending tensile force in said tension member is exceeded, so that the relative movement between said anchor member and said tension member takes place until the predetermined axially extending tensile force drops below a pre-set value.

7. Rock anchor assembly, as set forth in claim 6, wherein said tension member is a rod-shaped member having an outer surface with load-carrying ribs projecting outwardly from the outer surface and forming at least a partial thread around the outer surface, and said anchor member is an anchor nut engageable with said ribs and arranged to strip said ribs when the predetermined axially extending tensile force in the rod-shaped member is exceeded affording relative movement between said rod-shaped member and said nut.

8. Rock anchor assembly, as set forth in claim 1, wherein said adhesive material is a synthetic resin adhesive material.

9. Rock anchor assembly, as set forth in claim 1, wherein a second anchor plate is located around said tension member adjacent to and axially outwardly from the trailing end of said sheathing tube, and said second anchoring means arranged to press said second anchor plate against the trailing end of said sheathing tube and to press the trailing end of the sheathing tube against said first anchor plate.

10. Method of securing a rock anchor assembly in an elongated borehole in a receiving material comprising the steps of forming the rock anchor assembly of an axially elongated tension member having a leading end and a trailing end, laterally enclosing the tension member within an axially elongated sheathing tube having a leading end and a trailing end with the leading end of said sheathing tube spaced along said tension member from the leading end thereof and the trailing end of said sheathing tube spaced along said tension member from the trailing end thereof whereby said tension member projects axially outwardly from the opposite ends of said sheathing tube, securing the leading end of said sheathing tube in positively locked engagement with said tension member, placing an anchor plate encircling and adjacent to the trailing end of the sheathing tube, injecting an adhesive material into the base of the borehole, placing the assembled tension member and sheathing tube into the borehole with the anchor plate located outside of the borehole at the surface of the receiving material containing the opening into the borehole so that the adhesive material anchors the leading end of said tension member projecting from the leading end of said sheathing tube within the borehole, placing an anchor member on the trailing end of said tension member and securing the anchor member in bearing contact with the anchor plate and pressing the anchor plate against the surface of the receiving material.

11. Method, as set forth in claim 10, including the steps of forming a mixing tip on the leading end of said tension member projecting outwardly from said sheathing tube for mixing the adhesive material within the borehole.

12. Method, as set forth in claim 10, including the steps of placing a netting on the surface of the receiving material in which the borehole is formed, placing the netting between the anchor plate and the surface of the receiving material and securing the netting by pressing the anchor plate against the netting onto the surface of the receiving material.

13. Method, as set forth in claim 12, placing a second netting on the receiving material overlapping an edge portion of the first netting and securing the nettings together at the overlapping location by placing a second anchor plate outwardly from the first mentioned anchor plate so that the first mentioned anchor plate presses one of the nettings against the surface of the receiving material and the second anchor plate presses the other netting in superposed contact with the first-mentioned anchor plate, and pressing the two anchor plates against the surface of the receiving material by means of said anchor member.

* * * * *